US007140564B2

(12) United States Patent
Frey et al.

(10) Patent No.: US 7,140,564 B2
(45) Date of Patent: Nov. 28, 2006

(54) METHOD FOR THE COMPUTER-BASED PROCESS CONTROL OF A FRAGMENTATION APPARATUS

(75) Inventors: Wolfgang Frey, Karlsruhe (DE); Walter Väth, Dobei (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 0 days.

(21) Appl. No.: 11/187,159

(22) Filed: Jul. 23, 2005

(65) Prior Publication Data

US 2005/0252886 A1 Nov. 17, 2005

Related U.S. Application Data

(63) Continuation-in-part of application No. PCT/EP04/00229, filed on May 20, 2004.

(30) Foreign Application Priority Data

Jan. 25, 2003 (DE) ..... 103 02 867

(51) Int. Cl.
*B02C 19/18* (2006.01)

(52) U.S. Cl. ..... 241/1; 219/69.17; 241/29

(58) Field of Classification Search ..... 241/1, 241/24.12, 24.13, 29, 46.01; 219/69.16, 219/69.17; 700/162
See application file for complete search history.

(56) References Cited

U.S. PATENT DOCUMENTS 3,749,958 A 7/1973 Ward

FOREIGN PATENT DOCUMENTS

| | | | |
|---|---|---|---|
| DE | 195 34 232 | | 3/1997 |
| DE | 19534232 | A1 * | 3/1997 |
| DE | 10014393 | A1 * | 6/2001 |
| JP | 10-180133 | A * | 7/1998 |

OTHER PUBLICATIONS

Fret et al., "Experimental results on the breakdown behavior of concrete immersed in water", Conference Record of the 25th International Power Modulator Symposium and 2002 High-Voltage Workshop. International Modulator Symposium, New York, New York, IEEE US. Jun. 20, 2002.

* cited by examiner

*Primary Examiner*—Geoffrey S. Evans
(74) *Attorney, Agent, or Firm*—Klaus J. Bach

(57) ABSTRACT

In a method for the computer-based process control of a fragmentation apparatus having an energy storage device which is discharged via a spark gap to a load consisting of fragmentation goods submerged in a process liquid and disposed in a space between two electrodes which is filled with a process liquid, electrical operating parameters are determined during at least one discharge of the spark gap, whereby, in the space between the electrodes, a discharge channel is formed, and the point in time $T_D$ when such a discharge channel is formed and the electric resistance $R_E$ of the discharge channel are used as control values for controlling the fragmentation apparatus.

1 Claim, 3 Drawing Sheets

METHOD FOR THE COMPUTER-BASED PROCESS CONTROL OF A FRAGMENTATION APPARATUS

This is a continuation-in-part application of international application PCT/EP2004/000229 filed Jan. 15, 2004 and claiming the priority of German application 103 02 867.6 filed Jan. 25, 2003.

The invention resides in a method for the computer supported process control of a fragmentation apparatus with a capacitive energy storage device which is discharge by way of a spark gap to fragmentation goods disposed in a process liquid between two electrodes. One electrode is at a reference potential, generally ground potential, while the other is on the potential of the spark gap, that is, the capacitive energy storage unit, after a discharge via the spark gap. During the fragmentation process, the electrode gap is disposed completely within the process liquid. The process liquid is generally water, but for special fragmentation processes, it may be alcohol or oil or a sub-cooled liquid gas such as nitrogen.

During the Power Modulator Conference in Hollywood in July 2002. W. Frey et al. have presented an expose' entitled "Experimental Results on the Breakdown Behavior of Concrete Immersed in Water". It is explained therein, how the efficiency of the electric impulse fragmentation of dielectric solid bodies, which are immersed in water, is determined by the characteristics of the propagation in the discharge channel from the electrode tip through the solid body to the electrode plate. Voltage and current measurements show that the phase ahead of the discharge depends strongly on the arrangement of the solid body material in the area between the electrodes. Short discharge delay times and low energy losses can be observed only when the space between the electrodes is completely filled with solid body material. In this case, the channel resistance calculated from the measurement is very high. If the discharge channel extends through a stretch of water the discharge delay times and the losses increase. Compared with a discharge channel through solid body material, a discharge channel in water has a small channel resistance with a small energy conversion in the channel.

Further experiments clearly show the gas enclosures in the solid body material play an important role for the discharge development in minerals.

In order to reasonably operate a fragmentation apparatus on an industrial scale, it must be automatically controllable. In such an apparatus, there are control values as the electrode distance and the degree of the material filling in the processing liquid in the space between the electrodes. The control values are: the discharge resistance $R_E$ and the discharge delay time $T_D$. With the known time dependent value of the discharge current i(t) and the charge voltage $V_L$ of the impulse generator, the fragmentation process is controlled with the aid of $R_E$ and $T_D$. The impulse generator is a Marx generator as it is known from the electrical high power impulse engineering field.

From examinations, it is known that: the resistance of a discharge in water $R_E$, that is without fragmentation goods, is small. This value is in the electric resistance range of 0.3 to 0.7 Ω.

The resistance of a discharge in the fragmentation goods is comparatively high; it is, dependent on the material, in the range of 1.0 to 4.0 Ω. If a mixture of water and fragmentation goods is disposed in the space between the electrodes, the discharge resistance is between the value extremes mentioned above. There is therefore a discharge resistance range in which a fragmentation operation can be reasonably or respectively optimally performed.

The discharge delay time $T_D$ of a discharge in water, without fragmentation goods, is high. The values start at about 1 μs. The time of a discharge in the fragmentation goods is low, a general value is 200 ns. If a mixture of water and fragmentation goods is in the space between the electrodes, the discharge delay time is between the value extremes mentioned above. This provides for a time-based discharge delay range in which the discharge delay time should be.

It is the object of the present invention to provide a method of operating a fragmentation apparatus by which the process can be repeatedly adjusted so as to optimize the operation of the fragmentation apparatus.

SUMMARY OF THE INVENTION

In a method for the computer-based process control of a fragmentation apparatus having an energy storage device which is discharged via a spark gap of a Marx generator to a load consisting of fragmentation goods submerged in a process liquid and disposed in a space between two electrodes which is filled with a process liquid, electrical operating parameters are determined during at least one discharge of the spark gap, whereby, in the space between the electrodes, a discharge channel is formed, and the point in time $T_D$ when such a discharge channel is formed and the electric resistance $R_E$ of the discharge channel are used as control values for controlling the fragmentation apparatus.

The invention will be described in greater detail below on the basis of the accompanying drawings.

DESCRIPTION OF A PREFERRED EMBODIMENT OF THE INVENTION

The state of the fragmentation apparatus is expressed by the discharge resistance $R_E$ and the discharge delay time $T_D$, consequently these two values need to be determined. This is done during each discharge or, if no large deviation is to be expected between discharges, at least after a predetermined number of subsequent discharges. Since a computer is involved in the execution of the procedure, it is no problem to determine the values with each discharge.

First, during the discharge, the time dependent value of the current i(t) through the space between the electrodes is measured (see FIG. 2), generally at the beginning of the breakdown of the spark gap at the Marx-generator. The first oscillation maximum of the damped current value curve at the time $t_{1max}$ is considered to be the start of a damped co-sinus oscillation of the form $$i(t-t_{1\max}) = t_{i\max} \cdot e^{-\frac{(t-t_{1\max})}{\beta}} \cdot \cos(\omega(t-t_{1\max})); \quad \text{for} \cdot t > t_{1\max},$$

The damping constant β is obtained with the common mathematical means from electrical circuit analysis $$\beta = \frac{R_1}{2L_G}; \text{ wherein } R_1 = R_G + R_E,$$

Figure 1:
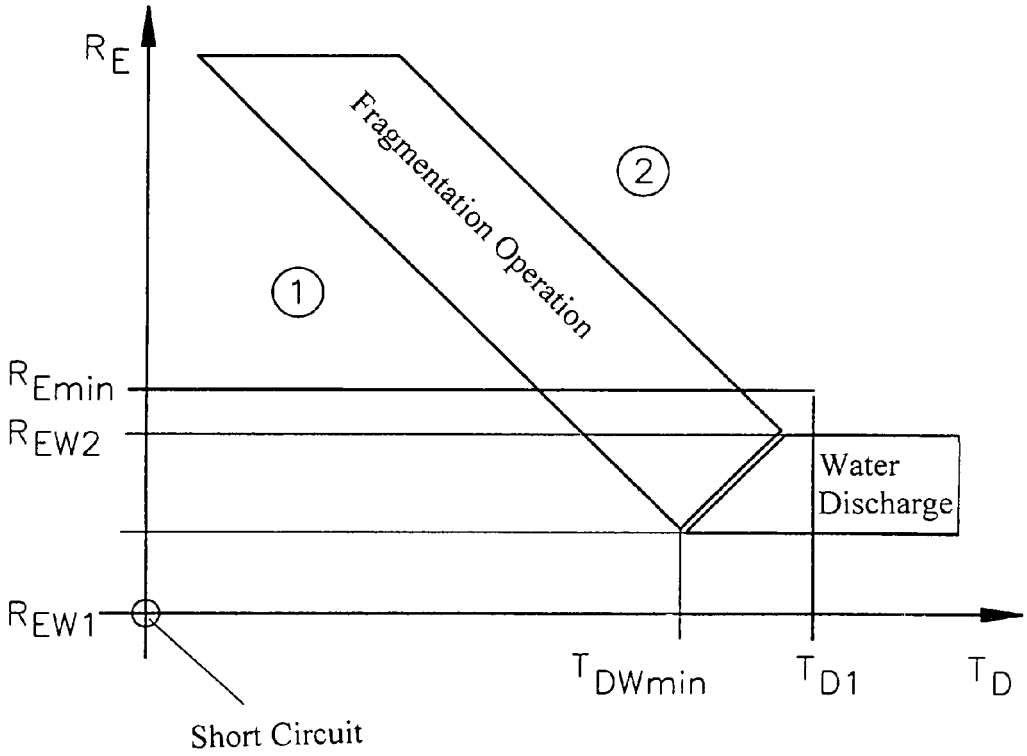
FIG. 1 shows the discharge resistance—discharge delay time diagram.

(see FIG. 1, $R_E$ represents the discharge resistance)

The circuit frequency of the damped oscillation is also known as $$\omega = \sqrt{\frac{1}{L_G C_s} - \frac{R_1^2}{4L_G^2}}$$

By algebraic conversion then an expression for the discharge resistance $R_E$ is obtained.

The discharge delay time $T_D$ is determined from the time-dependent current curve. It initiates the damped oscillation when a discharge channel has been fully developed between the two electrodes (See FIG. 2). Consequently, the two control values $R_E$ and $T_D$ are available which characterize the state of the fragmentation apparatus.

On the basis of FIG. 1, the momentary state can be determined and, depending on conditions, control signals for changing operating control values, such as electrode distance and/or degree of material filling can be provided. The desired value of the two control values $R_E$ and $T_D$ is disposed in FIG. 1 in the field "fragmentation operation" above the predetermined minimum resistance $R_{Emin}$.

The position of the two control values $R_E$ and $T_D$ and the control value change derived therefrom:

If $R_E$=0 and $T_D$=0, see FIG. 1, there is a short circuit. Consequently, the distance between the electrodes must be increased.

If the discharge resistance $R_E$ is between the smallest and the largest discharge resistance $R_{EW1}$ and $R_{EW2}$ of the process liquid alone and if the discharge delay time $T_D$ is greater than the smallest discharge delay time $T_{DWmin}$ in the process liquid alone, this indicates that no fragmentation goods are disposed in the space between the electrodes. Consequently, fragmentation good is added to the water in space between the electrodes.

If it is detected that the discharge resistance $R_E$ is greater than a predetermined minimum value $R_{Emin}$ and the discharge delay time $T_D$ is less than a predetermined maximum value $T_{DI}$ no adjustment is initiated since the two control values are in the desired field that is the "Green area" of fragmentation operation.

If fragmentation goods have already been added and the discharge resistance $R_E$ than drops from a high value below a minimum value $R_{Emin}$ fragmentation goods are again added.

For an economical operation, the fragmentation apparatus should always operate at maximum efficiency η. To this end, the two control values $R_E$ and $T_D$ must be constantly determined, in order to derive therefrom a possibly needed change of the control values so as to arrive at the optimum operating point. This operating point is obtained by a comparison of two energy components occurring with the electrical discharge, that is, the energy present in the energy storage of the Marx generator just before the discharge $E=\frac{1}{2} C_S(mU_L)^2$ and the discharge energy amount supplied to the space between the electrodes, with the discharge resistance $R_E$, i.e. the energy $$E_F = R_E \int_{T_D}^{\infty} i^2(t)\,dt,$$

that is, the energy converted in the discharge spark. ($U_L$ is the step-charge voltage in a Marx generator and m is the number of steps.) By forming the ratio $\eta=E_1/E_G$ and the control signal derived therefrom for changing the electrode distance and taking into consideration the two control values $R_E$ and $T_D$, with subsequent discharges a maximum for the efficiency η can be determined if the maximum has not yet been reached. With a good charge of the space between the electrodes with fragmentation goods, this means that the electrode distance control value to $\eta_{max}$ has been reached.

FIG. 1 shows two areas 1 and 2. If the control values $R_E$ and $T_D$ of the fragmentation apparatus are beyond the fragmentation operation area in the field 2, either the electrode distance is too high or the impulse voltage is too low. The latter condition may occur by an early breakdown of the spark gap in the Marx generator. If the control values $R_E$ and $T_D$ of the fragmentation apparatus are below the fragmentation operation area in the field 1, the electrode distance is too small. In both fields, 1 and 2, the operating settings of the fragmentation apparatus need to be adjusted such that the operating point is moved into the fragmentation operation area. This can be done by automatic control or, in exceptional cases, requires a local examination.

Figure 2:
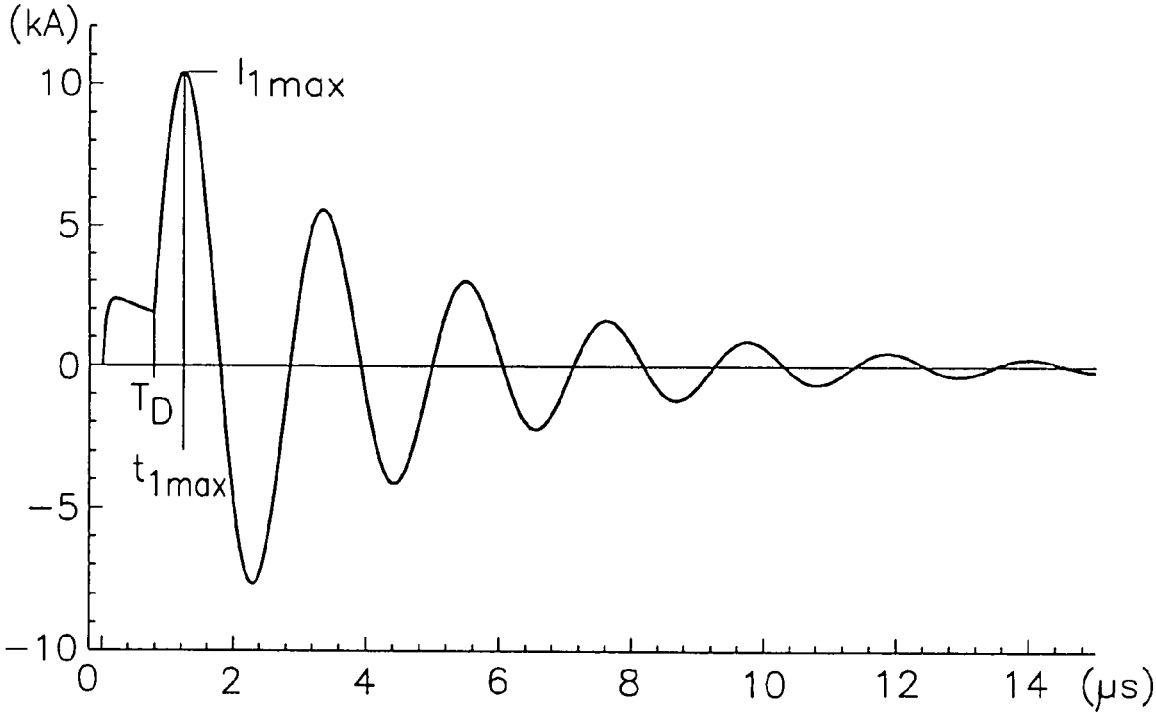
FIG. 2 shows the typical time-dependent discharge current curve i(t)

The typical discharge current curve i(t) during the electrodynamic fragmentation in the space between the electrodes is shown in FIG. 2 and is described generally in short below: During the pre-discharge phase, in a time interval $o<T_D$, there is a loss-current flow through the process liquid, generally water, but also other liquids such as oil, alcohol or liquid nitrogen to mention just a few. The discharge channel has, at this point in time, not yet bridged the electrode distance by forming a fragmentation effective discharge path. The discharge path is established at the time $T_D$. The energy input expressed by the integral $$E_F = R_E \int_{T_D}^{\infty} i^2(t)\,dt$$

occurs from this point in time. The control value $R_E$ is determined only by measuring the current; it is not necessary to measure the voltage with this method.

Figure 3:
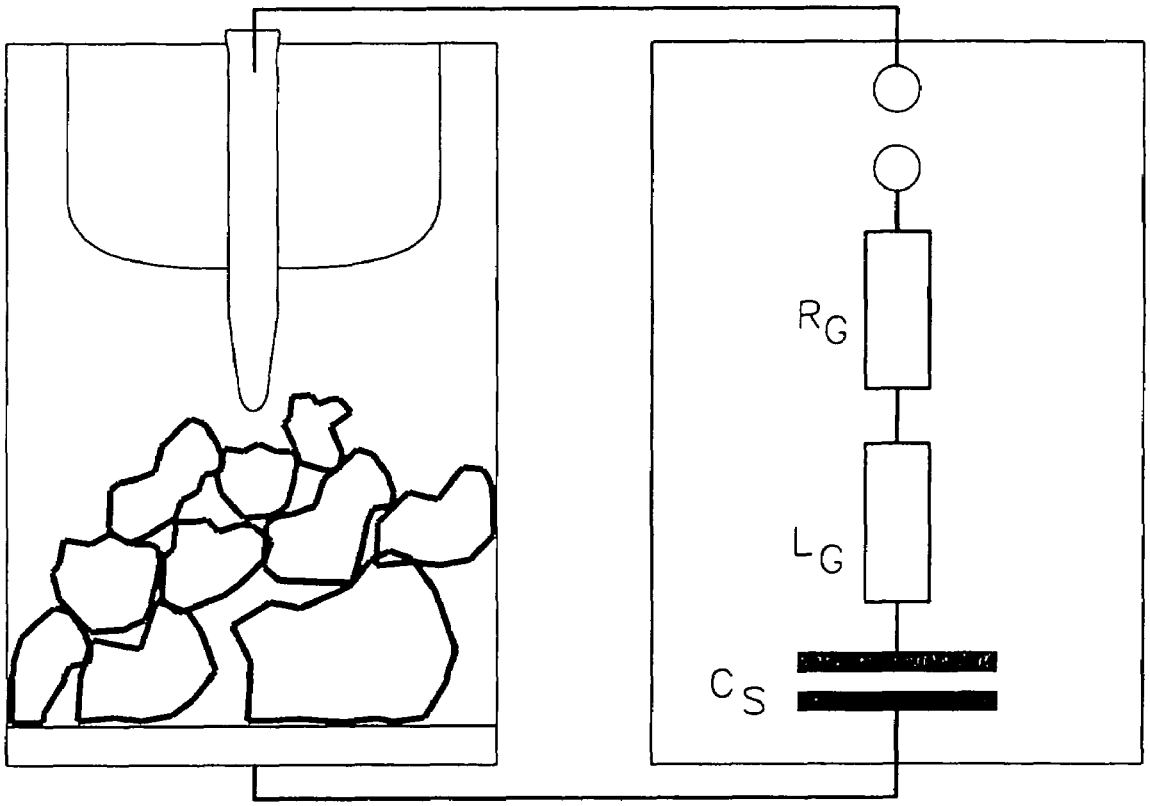
FIG. 3 shows schematically the fragmentation apparatus.

The fragmentation apparatus is operated for example by a Marx-generator. This is shown schematically in FIG. 3. The Marx generator consists of a capacitive energy storage device $C_S$ which, during the discharge, has a small but unavoidable inductivity $L_G$ (generator inductivity) and an ohmic resistance $R_G$ (generator resistance) which is also unavoidable. The two full points which are spaced from each other represent the spark gap. The electrical components framed in the box represent the Marx generator to which at right in FIG. 3, the load is connected. The load $R_E$ is the space between the two electrodes which are fully immersed into the operating liquid in which the fragmentation goods are disposed.

What is claimed is:

1. A method for a computer-based process control of a fragmentation apparatus including a capacitive energy storage device which is discharged via a spark gap to a load consisting of fragmentation goods submerged in a process liquid and disposed in a space between two electrodes of which one electrode is at a reference potential and the other is on the potential of the spark gap, and the space between the electrodes is filled with a process liquid, said method comprising the steps of:

A. determining electrical operating parameters during at least one discharge by measuring and recording the time-dependent oscillation pattern of the discharge current i(t), determining a discharge delay time $T_D$ from the pattern of the discharge current i(t) from the start of the damped oscillation pattern, determining the discharge resistance $R_E$ from the damping of the discharge current pattern;

B. examining the operating state of the fragmentation apparatus by comparing the two operating parameters most recently determined with the desired field in which the two should be disposed and forming a control signal for changing the processing state in the following way:

if the discharge resistance $R_E$ is between the smallest and the largest discharge resistance value $R_{EW1}$ and $R_{EW2}$ of the process liquid alone and if the discharge delay time $T_D$ is greater than the smallest discharge delay time in the process liquid alone, supplying fragmentation goods to the space between the electrodes, if the discharge resistance $R_E$ is larger than a predetermined minimum value $R_{Emin}$, and the discharge delay time $T_D$ is smaller than a predetermined maximum value $T_{Dt}$, taking no action—a fragmentation good has already been added—and if the discharge resistance $R_E$ subsequently drops below a minimum value $R_{Emin}$, adding fragmentation goods; and C. Determining the best operating point:

comparing the storage energy $E_g = \frac{1}{2} C_5 (mU_L)^2$) transferred during a discharge to the energy storage device just before the discharge with the energy $$E_F = R_E \int_{T_D}^{\infty} i^2(t)\,dt$$

by forming the ratio $\eta = E_F/E_G$ and deriving therefrom a control signal for changing the electrode distance if the maximum of $\eta$ has not yet been reached and adjusting the electrode distance.

* * * * *